United States Patent [19]

Joyce, Jr.

[11] 4,366,635

[45] Jan. 4, 1983

[54] PIVOTING EJECTOR FOR ELEVATOR SCRAPER

[75] Inventor: Hardin Joyce, Jr., Springfield, Ill.

[73] Assignee: Fiat-Allis Construction Machinery, Inc., Deerfield, Ill.

[21] Appl. No.: 207,993

[22] Filed: Nov. 18, 1980

[51] Int. Cl.[3] ..... B60P 1/36; E02F 5/00

[52] U.S. Cl. ..... 37/8; 37/126 AB; 37/126 AE

[58] Field of Search ..... 37/8, 124 R, 126 AB, 37/126 AE, 129

[56] References Cited

U.S. PATENT DOCUMENTS

| | | | |
|---|---|---|---|
| 2,988,832 | 6/1961 | Hancock et al. | 37/8 X |
| 2,994,976 | 8/1961 | Hancock | 37/8 X |
| 3,066,429 | 12/1962 | Hancock | 37/8 X |
| 3,321,094 | 5/1967 | Shore | 37/8 X |
| 3,465,458 | 9/1969 | Wagner | 37/129 |
| 3,581,415 | 6/1971 | Campbell et al. | 37/8 |
| 3,596,383 | 8/1971 | Bispo et al. | 37/8 |
| 3,739,504 | 6/1973 | Miller | 37/8 X |

*Primary Examiner*—E. H. Eickholt

*Attorney, Agent, or Firm*—Robert A. Brown

[57] ABSTRACT

A pivoting ejector for an elevator scraper including an ejector member pivotally attached to the scraper bowl capable of undergoing forward movement therein to urge earth material from the bowl for discharge, while undergoing pivotal movement to prevent contact of the elevator member with the elevator. A hydraulic control circuit governs the amount of forward and pivotal movement of the ejector member during discharge of the scraper, and further effects upward movement of a pivotally mounted elevator, either independently or in cooperation with the ejector member.

14 Claims, 5 Drawing Figures

PIVOTING EJECTOR FOR ELEVATOR SCRAPER

BACKGROUND OF THE INVENTION

This invention relates in general to vehicles, and in particular, to construction machinery such as earthmoving equipment.

More specifically, but without restriction to the particular use which is shown and described, this invention relates to a pivoting ejector assembly for a vehicle, such as a scraper or the like, for collecting and discharging material retained within the vehicle during use. The pivoting ejector assembly includes an ejector gate or member operably mounted for pivotal movement within the bowl of a scraper or the like. The ejector gate is adapted to sweep material collected in the bowl to a position for discharge therefrom, the operates in cooperation with a pivotally mounted elevator to allow a greater extent of movement of the ejector member for improved collection capacity and discharge of material. The pivoting ejector assembly, and elevator assembly, are controlled by a novel hydraulic circuit, attaining improved operation of both components during operation of the earthmoving equipment.

One type of construction machinery commonly used in earth moving operations is known as a scraper that utilizes a blade to engage the surface and dislodge earth material. The dislodged material is then carried by means of an elevator system for retention in a collection box known in the art as a bowl. After a scraping operation is completed, the earth material may be transported to a desired location and the contents of the bowl discharged. One common technique of discharging material collected in the bowl is through the use of a movable floor. In a bowl having a movable floor, at least a portion of the bowl floor moves from a closed position to an open position, permitting material to be dumped through a discharge opening.

In the dumping mode, the earth material is moved by a movable ejector member into the vicinity of the opening exposed by the movable floor. The ejector member is accordingly urged from a collection position, at which it serves as an upright wall of the bowl, to a discharge position to sweep or carry the material collected in the bowl to the discharge opening. A well known movable floor mechanism for scrapers employs floor mounted rollers to facilitate the movement between an open and closed position. The use of a roller support for such floors, however, requires constant and often tedious adjustment to maintain efficient operation of the scraper. In operation, hard substances, such as rocks and other solids, tend to lodge under the rollers and cause binding to interfere with the opening of the bowl to dump a load, or its subsequent closing to resume earth moving operations.

Another type of scraper employs a bowl having a fixed bottom and an open end, generally confronting the elevator. A fixed bottom bowl solves some of the operational problems associated with the movable floor technique, but also possesses its own shortcomings. For example, the inherent design of a bowl having a fixed floor requires that the ejector gate, in comparison to a movable floor bowl, move a greater distance to discharge material and at a fixed and flatter angle to avoid structural interference with the scraper elevator. Known ejector members, retained at fixed angles, must be of limited height to insure that their top portions do not strike the elevator during a dumping operation. This imposition of a limitation to the height of the ejector results in a reduction of the load capacity of the bowl in the retracted position of the ejector. Examples of prior art bowl assemblies suffering from the foregoing deficiencies are disclosed in U.S. Pat. No. 3,334,428 to Rezabek, U.S. Pat. No. 3,296,716 to Rezabek, et al., U.S. Pat. No. 3,462,859 to Hawk and U.S. Pat. No. 3,916,545 to Hochmann, et al.

The requisite movement of the ejector member in a bowl is generally effected by hydraulic cylinders controlled by a suitable hydraulic control circuit. The conventional control circuits of the prior art have been deficient in providing means to effectively prevent contact between the ejector and elevator during the discharge operation of the scraper. One recent type of ejector control circuit, attempting to avoid interfering contact between a fixed angle ejector member and an elevator, is disclosed in U.S. Pat. No. 3,977,100 to Boersma.

SUMMARY OF THE INVENTION

It is, therefore, an object of this invention to improve the collection and discharge of material dislodged during operation of construction machinery, such as a scraper and the like.

Another object of this invention is to improve the ejector assembly for use with a scraper bowl.

A still further object of this invention is to prevent interference between the ejector assembly and scraper elevator during discharge of collected material.

Still another object of this invention is to move an elevator of a scraper from an operational collection position to a remote discharge position.

A still further object of this invention is to control operation of the elevator and ejector assembly of a scraper to maintain suitable clearance during operation.

Still another object of this invention is to pivotally mount the elevator and ejector assembly to the scraper bowl.

These and other objects are attained in accordance with the present invention wherein there is provided an ejector assembly for an elevator scraper employing a pivoting ejector member, which forms an operative component of the bowl. Pivotal mounting of the ejector member of the invention permits the gate to stand more vertical in the retracted position, compared to the prior art ejectors, and increases the load volume, which may be collected in the bowl. Moreover, the novel pivotal action of the ejector gate during discharge insures clearance of the upper portion of the ejector under the elevator, while satisfactorily sweeping the fixed floor to dump the earth material.

The elevator is further pivotally mounted on the bowl to prevent contact with the ejector member by swinging upward from the bowl during material discharge. The invention of the application includes a novel hydraulic control circuit by which movement of the elevator and ejector is controlled, such that possible physical interference between the elevator and the ejector is eliminated. Thus, the invention herein disclosed increases load capacity of a fixed floor bowl, while permitting effective discharge of collected material.

DESCRIPTION OF THE DRAWINGS

Further objects of the invention, together with additional features contributing thereto and advantages accruing therefrom, will be apparent from the following description of a preferred embodiment of the invention, which is shown in the accompanying drawing with like reference numerals indicating corresponding parts throughout, wherein.

DESCRIPTION OF THE PREFERRED EMBODIMENT

Although not intended to be so limited, for convenience of illustration, the pivoting ejector assembly of the invention is described for use in conjunction with construction machinery, in the form of a scraper and the like. Scrapers are employed in earthmoving operations to dislodge earth material for collection and dumping at a desired location.

Figure 1:
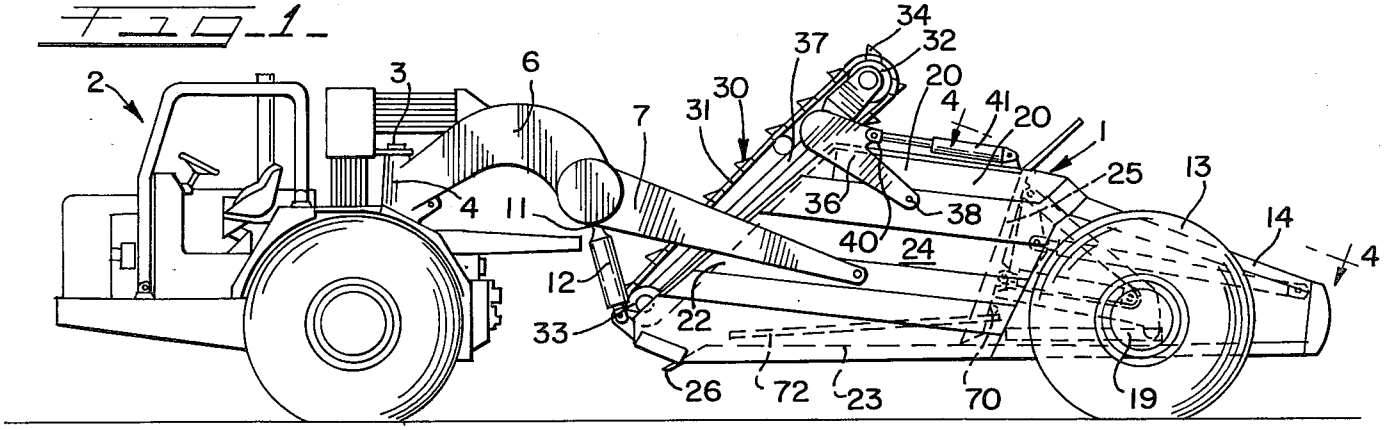
FIG. 1 is a side schematic view of a two-wheel tractor and attached scraper employing the pivoting ejector assembly of the invention.

In FIG. 1, there is illustrated a scraper 1 employing a pivoting ejector assembly of the invention, and generally designated by the reference numeral 10. The scraper 1 is propelled by a two-wheel tractor 2 providing motive force for operation of the scraper, although other types of self-propelled vehicles may be used in conjunction with the machinery. The scraper 1 is attached to a kingpin 3 of the tractor 2 by means of a draft frame, comprising a kingpin housing 4 attached to a forward portion of a gooseneck 6, and a pair of draft arms 7 (one of which is shown in FIG. 1). The draft arms 7 are pivotally mounted on both sides of the vehicle to the gooseneck 6 and to scraper 1 by suitable attachment means.

The scraper 1 is further coupled to a bracket 11, extending from the gooseneck 6, by means of a pair of extension mechanisms, such as a hydraulic actuator or cylinder 12 (one of which is shown in FIG. 1). The hydraulic actuators 12 in operation control the elevation of scraper 1 with respect to the ground surface. The rear of the scraper 1 is carried by a pair of wheels 13 supporting a rear push frame 14. A scraper bowl 20 is suitably affixed for pivotal movement, relative to the scraper axle 19, to the forward portion of the push frame 14 and acts to collect and substantially discharge or dump the material dislodged by the scraper. The bowl 20 is constructed as a housing, having an open top 21 and front side 22, defined by a fixed lower floor 23, a pair of sidewalls 24 (one of which is shown in FIG. 1), and a backwall 25 in the form of an ejector member or gate of the pivoting ejector assembly 10 of the invention. A cutting edge or blade 26 is mounted on a fixed blade base positioned adjacent to the front portion of the bowl 20. Actuation of the hydraulic actuators 12 lowers the scraper to a desired work position to permit the blade edge to dislodge earth material during movement of the vehicle.

Figure 2:
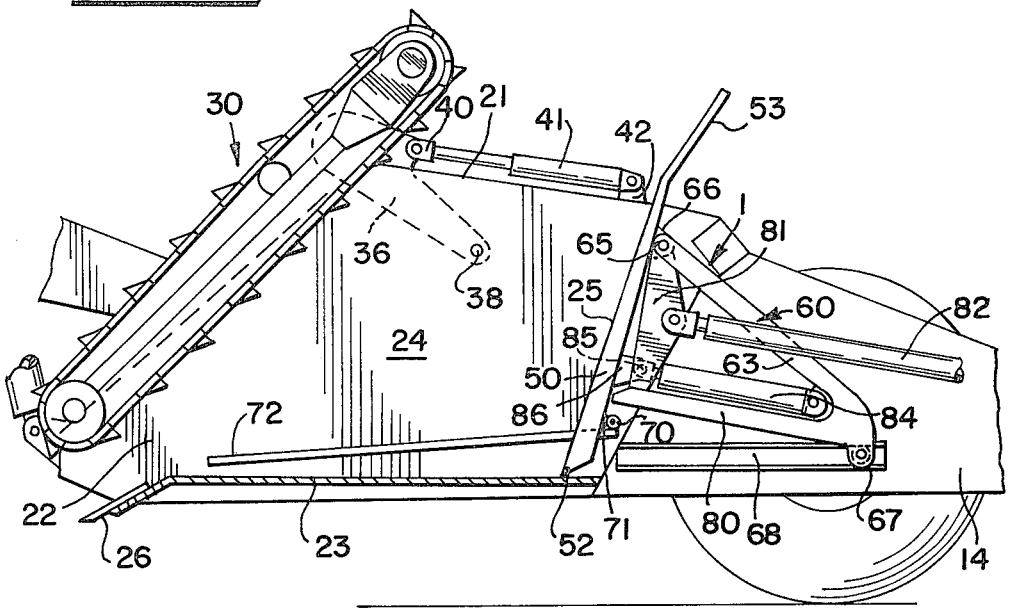
FIG. 2 is a side schematic view, with parts in section, of the bowl of the scraper shown in FIG. 1 with the pivoting ejector of the invention in a retracted position.
Figure 3:
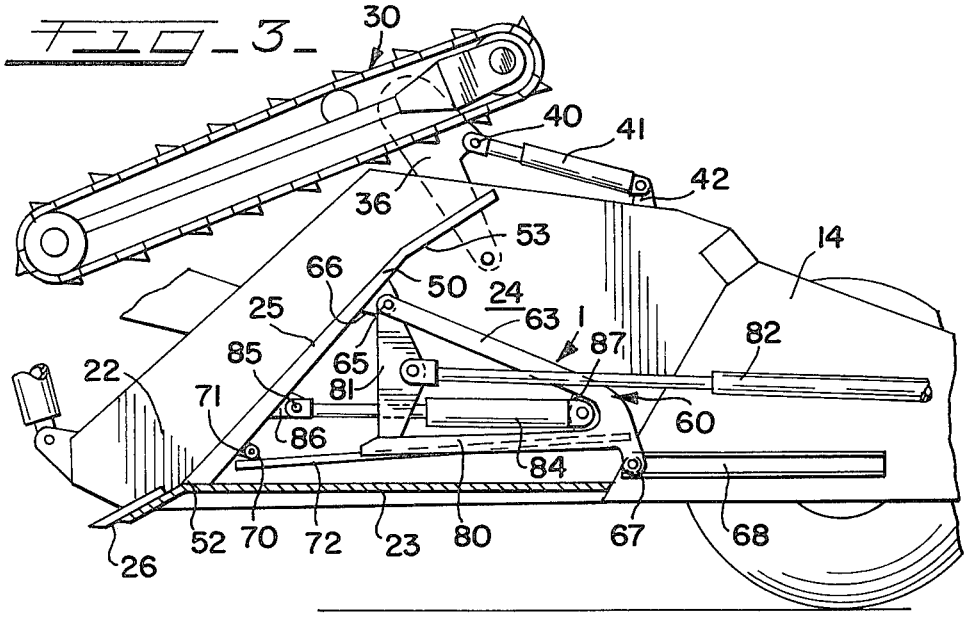
FIG. 3 is a side schematic view, with parts in section, of the bowl of the scraper of FIG. 1 with the pivoting ejector assembly of the invention in an extended discharge position.

The material, dislodged by the cutting edge of the blade, is collected and carried to the bowl 20 by means of an elevator 30. The elevator includes a movable link chain 31 mounted about a drive roller 32 and idler roller 33. The link chain 31 carries a plurality of spaced flights or drags 34 that transport the earth material dislodged by the cutting blade upward for deposit in the bowl 20. Although the endless chain 31 may move in the opposite direction, the flights 34 are mounted for movement about the rollers 32 and 33 in a counterclockwise direction, when viewing FIG. 1. The elevator 30 is pivotally supported on the bowl 20 by means of a pair of arms 36 (one of the arms 36 is shown in FIGS. 1, 2 and 3). The arms are situated on opposite sides of the elevator 30 and are rigidly coupled to the elevator frame 37 by suitable attachment means (not shown).

The lower ends of each of the arms 36 are pivotally attached to the outer surface of a respective sidewall 24 by means of a suitable pin arrangement 38. The pivotal mounting of the arms 36 to the sidewalls 24 permits the elevator to be swung upward during a discharge operation in a manner to be apparent in the following description. As also shown in FIGS. 1 through 3, each of the arms 36 is pivotally coupled to the extension end 40 of a respective hydraulic actuator or cylinder 41. The hydraulic cylinders 41 are retained at their opposite ends for pivotal movement on a projection 42 affixed to the sidewalls 24 of the bowl 20, as shown in FIGS. 1 to 4. The hydraulic cylinders 41 act to move the elevator 30 from the position shown in FIG. 2, at which material is being collected by the elevator, to the position shown in FIG. 3, at which the material collected in the bowl 20 may be discharged. Operation of the hydraulic cylinders 41 is controlled by a novel hydraulic control circuit to be described.

As described previously, the pivoting ejector assembly 10 of the invention functions in its retracted position as the backwall 25 of the bowl 20 in the material collecting mode of the scraper, as illustrated in FIG. 2. The pivoting ejector assembly 10 includes an ejector member or gate 50 having an inner surface forming the backwall 25 of the bowl 20. Although other shapes may be employed, ejector gate 50 is formed with an upward, tapering cross-sectional configuration, as shown in FIG. 2, including a lower strike-off blade 52 for scraping material from the fixed floor 23 of the bowl 20. The upper portion 53 of the gate 50 is disposed at an angular orientation to the plane of the surface 25 and is formed with an approximate non-tapering cross-sectional shape.

Figure 4:
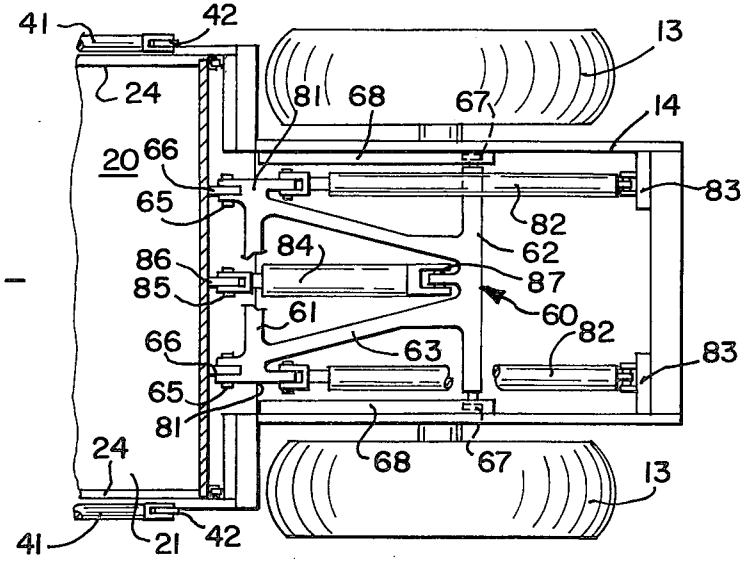
FIG. 4 is a partial top schematic view, with parts in section, of the mounting assembly of the pivoting ejector assembly of the invention taken along lines 4—4 of FIG. 1.

The pivoting ejector gate 50 is supported by a guide frame 60, which is capable of movement relative to the push frame 14 during a discharge operation of the ejector member. The guide frame 60 includes an upper cross framing member 61 and a lower rear cross framing member 62 (FIG. 4), which are interconnected by integrally attached central frame segments 63. The frame segments 63 extend downward toward each other from the upper frame member 61 to the lower frame member 62 as best shown in FIG. 4. The upper end portion 64 of the frame segments 63 are pivotally attached by a pin arrangement 65 to brackets 66 affixed to the backside of the ejector gate 50. The pivotal coupling of the ejector gate 50 to the guide frame 60 mounts the ejector gate 50 for selected pivoting movement relative to the bowl 20 about an axis extending laterally of the scraper.

The opposite ends of the lower cross support member 62 carry a pair of rollers 67, which are adapted to move in guided relationship along longitudinally extending tracks 68, suitably affixed to a portion of the push frame 14. Although specifically not shown, the tracks may be curved to alter the movement of the ejector gate, if desired. The lower portion of the ejector gate 50 supports a pair of lower rollers 70 (one of which is shown in FIGS. 1, 2 and 3) by means of respective brackets 71 affixed to the back of the ejector gate 50. During movement of the ejector gate 50 between the retracted position shown in FIG. 2 and the fully extended discharge position shown in FIG. 3, the rollers 70 ride on respective rails 72 affixed in a slight downward orientation longitudinally along the inner surfaces of the bowl sidewalls 24.

The guide frame 60 further includes a pair of lower members 80, which are integrally attached to the lower cross member 62 and extend forward to a point adjacent the ejector gate 50 in the retracted position shown in FIG. 2. A pair of upright members 81 are rigidly coupled by a suitable technique to the lower frame member 80 and extend upward into integral coupling to the upper cross member 61 and central frame segments 63. The extensible end of each one of a pair of hydraulic cylinders 82 is coupled to a respective upright member 81 by a pivotal coupling as shown in FIGS. 2, 3 and 4. The opposite ends of the hydraulic cylinder 82 are pivotally supported on blocks 83 attached to the scraper push frame 14. The extensible end of an additional hydraulic cylinder 84 is pivotally attached by a pin arrangement 85 to a bracket 86 affixed to the ejector member 50. The opposite end of the hydraulic cylinder 84 is coupled by a pivotal mounting 87 attached to the guide frame cross member 62.

In the position shown in FIG. 2, the elevator 30 and ejector member 50 are in an orientation to permit collection of earth material. In such a position, the elevator functions to carry material to the bowl 20, and the ejector member 50 acts as the backwall 25 of the bowl. The extensible ends of the elevator hydraulic cylinders 41 are then in an extended configuration as shown in FIG. 2, while the extensible ends of the hydraulic cylinders 82 and the hydraulic cylinder 84, controlling the ejector member 50, are in a retracted state. Discharge of the material collected in the bowl 20 during operation of the scraper is effected by moving the ejector member 50 to the position of FIG. 3 to push the material through the open front side 22 of the bowl 20, while scraping the floor 23.

The forward movement of the ejector member 50 from the position of FIG. 2 to the position of FIG. 3, is accomplished through extension of the actuating hydraulic cylinders 84. To prevent interference between the elevator 30 and the ejector member 50 during this movement, the elevator hydraulic cylinder 41 is retracted to swing the elevator 30 upward, and the hydraulic cylinder 84 is extended to cause a pivoting clockwise rotation of the ejector gate 50 relative to the guide frame 60 about pin arrangement 65, as the ejector moves forward in the bowl. This novel cooperative movement of the elevator 30 and the ejector gate 50 prevents physical contact and possible damage to these components. The actuation of the hydraulic cylinders 41, hydraulic cylinders 82, and hydraulic cylinder 84 is controlled by a novel hydraulic control circuit to be described in connection with FIG. 5. Reversal of the operation of the respective hydraulic cylinders at the conclusion of a dumping operation permits the elevator 30 and the ejector gate 50 to return to the collection position of FIG. 2.

Figure 5:
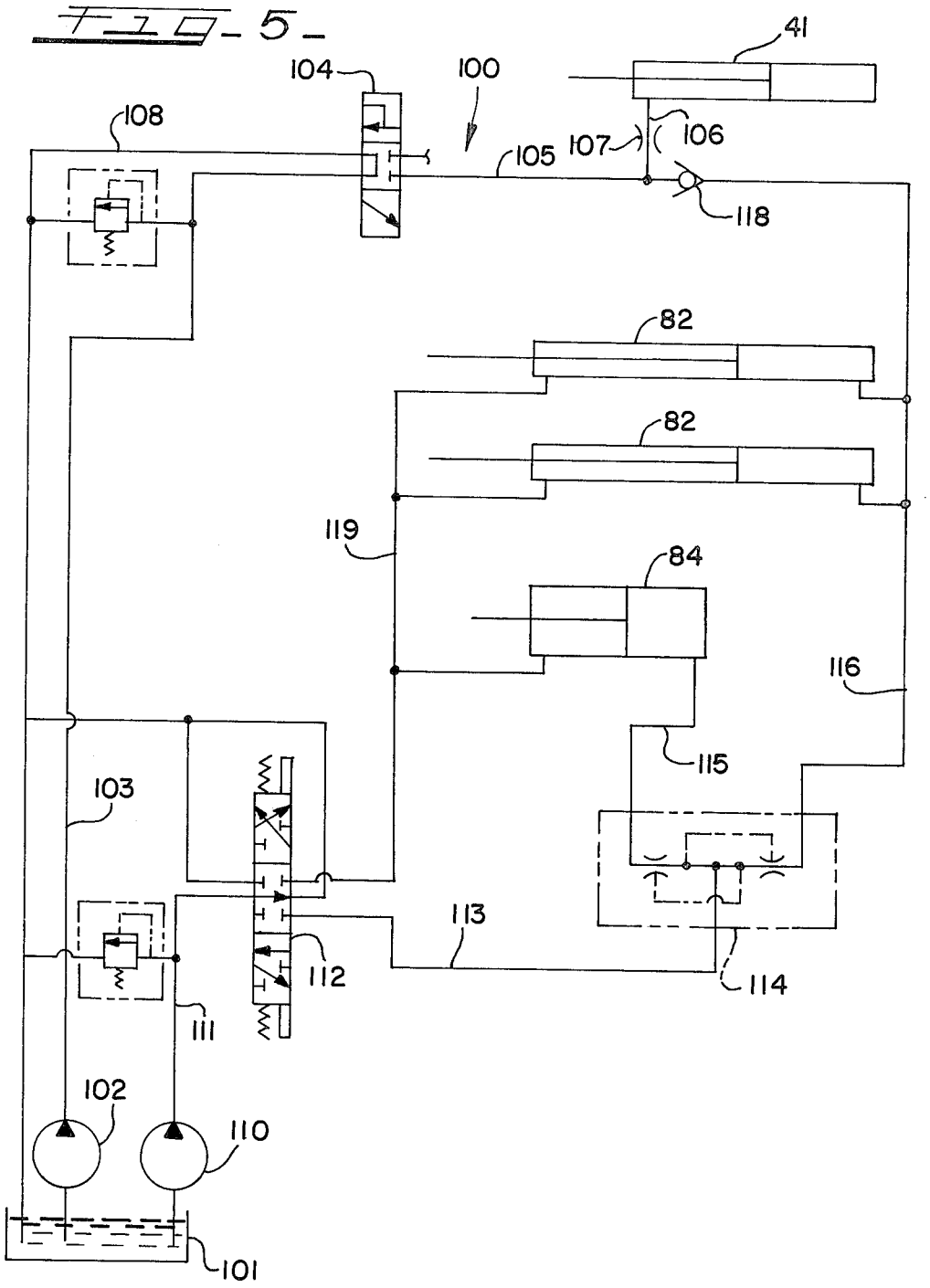
FIG. 5 is a schematic view of the hydraulic control circuit for controlling movement of the pivoting ejector assembly of the invention in cooperation with movement of the elevator.

Referring now to FIG. 5, there is illustrated an hydraulic control circuit 100 for effecting operation of the ejector member 50 and elevator 30 through actuation and control of the operation of the hydraulic cylinders coupled to these components. The hydraulic circuit 100 includes a suitable hydraulic reservoir 101 maintaining a supply of hydraulic fluid and the like for use in the hydraulic cylinders 41, 82 and 84. A first pump 102 is situated in a fluid line 103 and is disposed in fluid communication between the reservoir 101 and an elevator control valve 104.

The elevator control valve 104 comprises a manually operated, three position device (neutral, raise and lower) of conventional design, which is spring centered in the center (hold) position with no detents in the raise or lower position. The output of the valve 104 is coupled in fluid communication to the elevator hydraulic cylinder 41 by fluid line 105 and a branch fluid line 106 having an orifice 107. The center (hold) position of the valve 104 creates fluid communication between fluid line 101 and a return fluid line 108 to the reservoir.

A second pump 110 delivers hydraulic fluid from the reservoir 101 through the fluid line 111 to an ejector gate control valve 112, which is also a three position, variable, spring centered hydraulic device of known type. The control valve 112 is positionable in a neutral position, a collection position, and a discharge position for operation of the ejector member 50. The ejector valve 112 is connected to a fluid divider 114 by a fluid line 113. The fluid divider 114 is a conventional fluid device, which produces a pair of proportional fluid outputs of a selected ratio through fluid lines 115 and 116. The fluid line 115 is in fluid communication with the ejector hydraulic cylinder 84, and the fluid line 116 is coupled in parallel to each of the hydraulic cylinders 82. The fluid line 116 further couples in fluid communication with the fluid line 105 across a check valve 118. The check valve 118 may comprise any suitable check valve, such as a spring biased, normally closed device, positioned between the fluid line 105 and the fluid line 116 and operative to open in response to a pressure buildup in the fluid line 116. The control valve 112 is further coupled in fluid communication to opposite sides of the hydraulic cylinders 82 and 84 through fluid lines 119.

In operation, the supply of hydraulic fluid to ejector assembly cylinders 82 and 84 is supplied by the second pump 110 under control of the control valve 112. To effect extension of the ejector member 50 for discharge of earth material from the bowl 20, the three positional valve 112 is manually moved from the neutral position to the discharge position. Hydraulic fluid is supplied to the hydraulic cylinder 82 and the hydraulic cylinder 84 at the proportion determined by the flow divider 114 to cause extension thereof, such that forward movement of the ejector gate 50 and its associated pivoting are controlled to the extent to prevent the top portion of the ejector member 50 from contacting the elevator 30. In the discharging mode, pressure buildup in the fluid line 116 will also open the check valve 118 and automatically actuate the elevator hydraulic cylinder 41 to lift the elevator to the position of FIG. 3, when the valve 104 is in a center (hold) position. The hydraulic cylinders 82 and 84 may be reversed at the conclusion of a dumping operation by moving the valve 112 to the retract position and returning the ejector member 50 and the elevator 30 to the operative position of FIG. 2. The extensible ends of the hydraulic cylinders 82 and 84 are caused to retract, while the elevator hydraulic cylinders 41 move to their extended configuration to cause the elevator 30 to return to the operative position of FIG. 2. The elevator may be independently operated, to be raised or lowered between the positions illustrated in FIGS. 2 and 3, by manually moving the three way valve 112 to either its raise or lower position from its normally neutral (central) position.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An ejector assembly for the bowl of an earth moving assembly comprising bowl means for collecting and discharging earth material dislodged by an earth moving vehicle, said bowl means including a discharge opening for selectively discharging collected earth material, elevator means pivotally coupled to said bowl means for transporting earth material dislodged by an earthmoving vehicle into said bowl means, ejector means connected to said bowl means and having an ejector member forming a wall of said bowl means, said ejector member being selectively pivotable relative to said ejector means and movable longitudinally to urge the collected earth material to said discharge opening for discharge from said bowl means, fluid actuation means coupled to said ejector means for pivoting said ejector member away from said elevator means, and for moving said ejector member longitudinally relative to said bowl means to discharge earth material therefrom, and control means coupled to said actuation means to control the degree of pivoting movement of said ejector member relative to said longitudinal movement to prevent contact of said ejector member with said elevator means during discharge of earth material.

2. An ejector assembly according to claim 1 wherein said control means preventing contact between said ejector member and said elevator means includes hydraulic control means.

3. The ejector assembly according to claim 1 wherein said ejector means includes an ejector guide means coupled to said ejector member to guide said pivoting and longitudinal movement of said ejector member.

4. The ejector assembly according to claim 3 wherein said ejector guide means includes roller means to effect movement of said ejector guide means.

5. The ejector assembly according to claim 1 wherein said elevator means is movable between an operative position to carry earth material to said bowl means to a discharge position to permit discharge of earth material from said bowl means.

6. The ejector assembly according to claim 5 further including second actuation means coupled to said elevator means for moving said elevator means between said operative position and said discharge position.

7. The ejector assembly according to claim 6 wherein said second actuation means is operatively coupled to said control means.

8. The ejector assembly according to claim 6 further including arm means coupled to said elevator means and pivotally mounted to said bowl means.

9. The ejector assembly according to claim 8 wherein said second actuation means is operatively coupled to said arm means and said bowl means.

10. An ejector assembly for the bowl of an earthmoving assembly comprising bowl means for collecting and discharging earth material dislodged by an earthmoving vehicle, said bowl means including a discharge opening for selectively discharging collected earth material, elevator means pivotally coupled to said bowl means for transporting earth material dislodged by an earthmoving vehicle into said bowl means, said elevator means being movable between an operative position to carry earth material to said bowl means to a discharge position to permit discharge of earth material from said bowl means, ejector means connected to said bowl means and having an upright member forming a wall of said bowl means and being selectively movable longitudinally relative thereto to urge the collected earth material to said discharge opening for discharge from said bowl means, first actuation means coupled to said ejector means for pivotally moving said upright member away from said elevator means and for longitudinally moving said ejector member relative to said bowl means to discharge earth material therefrom, and second actuation means coupled to said elevator means to move said elevator means from said operative position to said discharge position to controlled relationship with said movement of said ejector means.

11. An ejector assembly for the bowl of an earth moving assembly comprising bowl means for collecting and discharging earth material dislodged by an earth moving vehicle, said bowl means including a discharge opening for selectively discharging collected earth material, elevator means pivotally coupled to said bowl means for transporting earth material dislodged by an earthmoving vehicle into said bowl means, ejector means connected to said bowl means and having an ejector member forming a wall of said bowl means, said ejector member being selectively pivotable relative to said ejector means and movable longitudinally to urge the collected earth material to said discharge opening for discharge from said bowl means, actuation means coupled to said ejector means including first hydraulic cylinder means for pivoting said ejector member and second hydraulic cylinder means for longitudinally moving said ejector member relative to said bowl means to discharge earth material therefrom, and hydraulic control means coupled to said actuation means to control the degree of pivoting movement of said ejector member relative to said longitudinal movement to prevent contact of said ejector member with said elevator means during discharge of earth material.

12. The ejector assembly according to claim 11 wherein said hydraulic control means controls the supply of fluid to said first and second hydraulic cylinder means to move said ejector member.

13. The ejector assembly according to claim 12 wherein said hydraulic control means includes flow proportional means to control the supply of fluid to said first and second hydraulic cylinder means to prevent physical contact between said ejector member and said elevator means during said movement.

14. The ejector assembly according to claim 13 wherein said control means includes a flow divider.

* * * * *